United States Patent [19]

Nakatani

[11] Patent Number: 4,809,840

[45] **Date of Patent: * Mar. 7, 1989**

[54] CURVED ESCALATOR

[75] Inventor: Hiroshi Nakatani, Inazawa, Japan

[73] Assignee: Mitsubishi Denki Kabushiki Kaisha, Japan

[ * ] Notice: The portion of the term of this patent subsequent to May 5, 2004 has been disclaimed.

[21] Appl. No.: 44,826

[22] Filed: May 1, 1987

Related U.S. Application Data

[63] Continuation of Ser. No. 659,428, Oct. 10, 1984, Pat. No. 4,662,502.

[30] Foreign Application Priority Data

| | | | |
|---|---|---|---|
| Oct. 12, 1983 | [JP] | Japan | 58-190462 |
| Dec. 15, 1983 | [JP] | Japan | 58-236554 |
| Mar. 22, 1984 | [JP] | Japan | 59-54808 |

[51] Int. Cl.[4] ..... B66B 21/02

[52] U.S. Cl. ..... 198/328; 198/335

[58] Field of Search ..... 198/326, 328, 331, 335, 198/778

[56] References Cited

U.S. PATENT DOCUMENTS

| | | | |
|---|---|---|---|
| 701,459 | 6/1902 | Aston | 198/328 |
| 999,885 | 8/1911 | Seeberger | 198/328 |
| 3,878,931 | 4/1975 | Luna | 198/328 |
| 3,989,133 | 11/1976 | Courson et al. | 198/328 |
| 4,662,502 | 5/1987 | Nakatani | 198/328 |

FOREIGN PATENT DOCUMENTS

| | | | |
|---|---|---|---|
| 551716 | 5/1932 | Fed. Rep. of Germany | 198/326 |
| 650233 | 8/1937 | Fed. Rep. of Germany | 198/326 |
| 3432961 | 3/1985 | Fed. Rep. of Germany | 198/330 |

*Primary Examiner*—Robert J. Spar
*Assistant Examiner*—Lyle Kimms
*Attorney, Agent, or Firm*—Leydig, Voit & Mayer

[57] ABSTRACT

A curved escalator comprises a plurality of segment steps movable along the stairway path, an inner balustrade panel of balustrades vertically disposed along an outer and an inner side of the stairway path, a moving handrail supported by a handrail guide for a guided movement along the balustrade, a skirt guard mounted to the frame work and extending in parallel to a travel path of the steps, and a guide rail for guiding step axles of the steps. The guide rail varies in its radius of curvature and the position of its center of curvature along its length in accordance with the varying slope angle, and the handrail guide varies in its radius of curvature and the position of its center of curvature along its length in correspondence with the radius of curvature and the position of center of curvature of the guide rail.

5 Claims, 11 Drawing Sheets

CURVED ESCALATOR

BACKGROUND OF THE INVENTION

This application is a continuation by application Ser. No. 659,428, filed Oct. 10, 1984, now U.S. Pat. No. 4,662,502.

This invention relates to escalators and, more particularly, to curved escalators which have a stairway path that is curved in plan.

Typical circular or curved escalators have a stairway path along which a series of steps travel, the path having a constant radius of curvature in plan throughout its entire length including the horizontally-moving landing sections at the upper and lower ends of the escalator. The stairway path is defined by guide rails that support and guide various rollers mounted on the steps. The guide rail on the outer side of the circular stairway path and the guide rail on the inner side of the circular stairway path are different in gradient. Therefore, with guide rails of a constant radius of curvature, as in the escalator described above, the distance between the axes of step axles that connect the step to the driving chain must be variable in order that the angular velocities of the step at the outer and inner sides of the step be equal even in locations where the angle of slope changes, such as in the transition portions between the load-bearing inclined portion and the upper and lower horizontal landing portion. This requires a complex and expensive driving and guiding arrangement in the escalator.

In order to solve the above problems in curved escalators, U.S. patent application Ser. No. 526,132 proposes a curved escalator in which the radius of curvature of the guide tracks defining a stairway path when viewed in plan is inversely proportional to the slope of the various sections of the stairway path.

This application, however, is silent about the detailed arrangement for maintaining clearances between outer and inner skirt guards and side faces of the steps so as to be always constant. Therefore, the clearances between the skirt guards and the steps vary according to the position of the steps along the stairway path, posing the danger of foreign matter, such as a passenger's foot, being caught in the clearance. Also, the distance between the step and a moving handrail on the balustrade varies along the stairway path of the escalator, again posing a similar danger for the passenger.

Furthermore, inner panels on the balustrade for a curved escalator as disclosed in the above-mentioned U.S. patent application are formed in a three-dimensional shape. The three-dimensionally curved panel is much more expensive than other two-dimensional panels.

SUMMARY OF THE INVENTION

Accordingly, the chief object of the present invention is to provide a curved escalator which is simple in structure, less expensive, and free from the problems discussed above.

Another object of the present invention is to provide a curved escalator in which the angular velocities of the outer and the inner moving handrails are equal.

Another object of the present invention is to provide a curved escalator in which the distance between the steps and the moving handrail is constant along the direction of extension of the stairway path.

Still another object of the present invention is to provide a curved escalator in which the inner balustrade panel of the balustrade is divided into sections of simple configuration so that the manufacture of the panels can be made with a small number of press-forming dies at lower cost.

With the above objects in view, the present invention relates to a curved escalator comprising a stairway path curved in plan and having an intermediate section that has a predetermined constant slope angle, upper and lower landing sections that have substantially zero slope angle, and transition sections connecting the intermediate section to the upper and lower sections that have changing slope angles for the smooth connection of the sections. The curved escalator further comprises a plurality of segment steps movable along the stairway path, an inner balustrade panel of balustrades vertically disposed along the outer and the inner sides of the stairway path, a moving handrail supported by a handrail guide rail for guided movement along the balustrade, a skirt guard mounted to the frame work and extending in parallel to a travel path of the steps, and a guide rail for guiding step axles of the steps.

The step guide rail varies in its radius of curvature and the position of its center of curvature along its length in accordance with the varying slope angle, and the handrail guide rail varies in its radius of curvature and the position of its center of curvature along its length in correspondence with the radius of curvature and the position of the center of curvature of the step guide rail.

DESCRIPTION OF THE PREFERRED EMBODIMENTS

Figure 1:
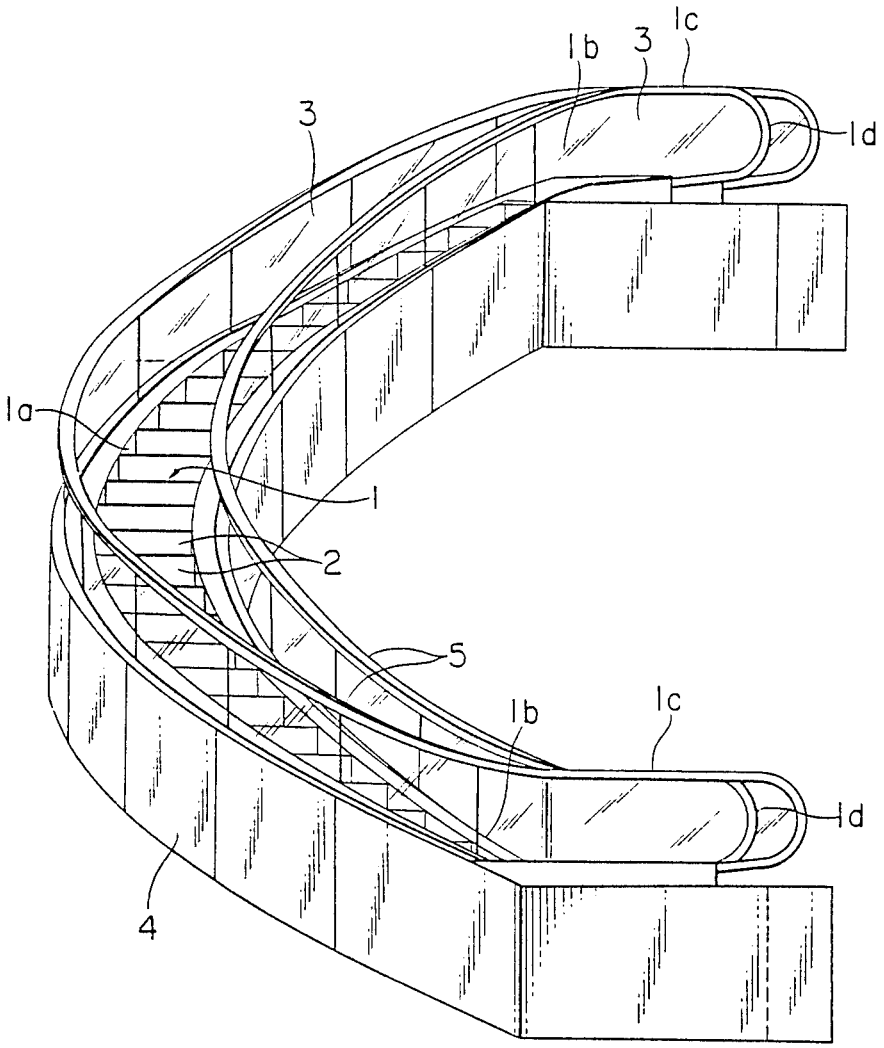
FIG. 1 is a front view of a curved escalator to which the present invention is applicable.
Figure 2:
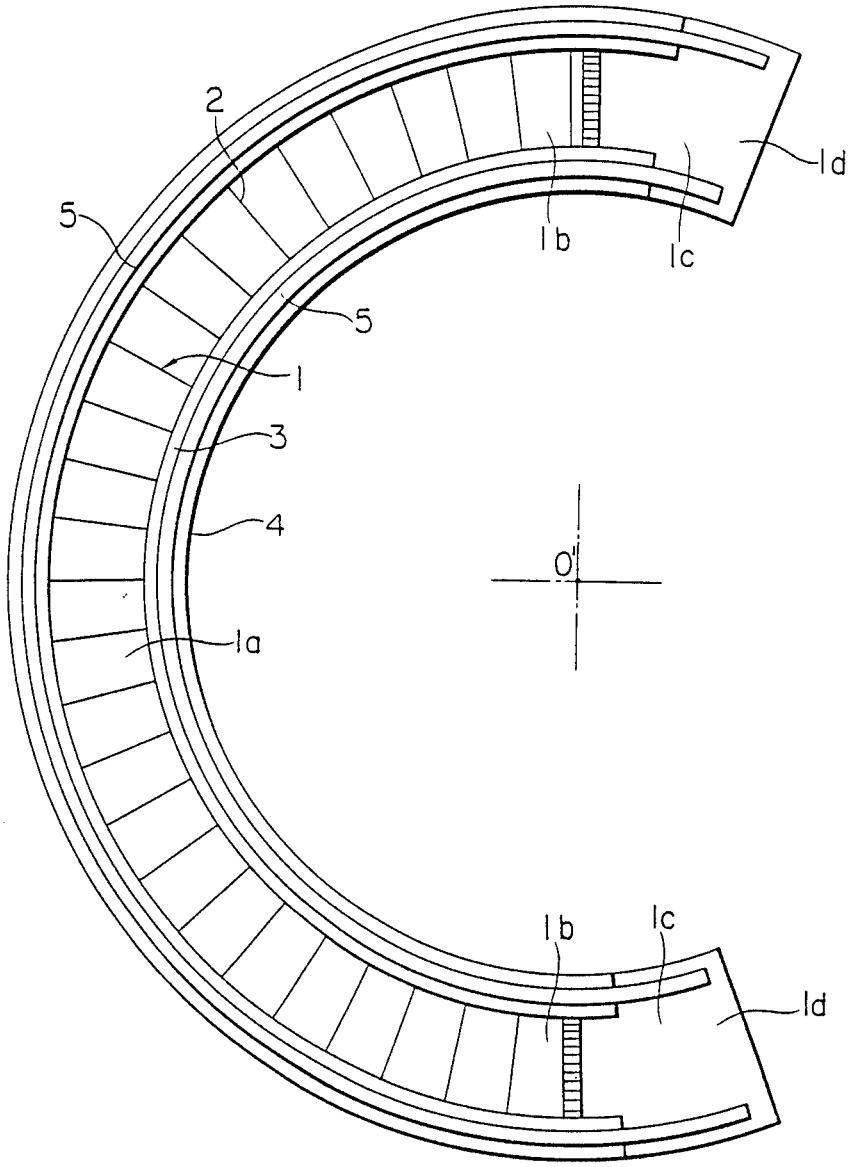
FIG. 2 is a plan view of the curved escalator shown in FIG. 1.

FIGS. 1 and 2 illustrate a typical curved escalator to which the present invention can be applied. The curved escalator has the general configuration of a spiral or has two ends that are vertically separated and connected by an arc when viewed in plan. The escalator comprises a frame 4 in which an endless belt 1 and drive and guiding mechanism, which will be described in more detail later, are installed. The escalator also comprises a plurality of steps 2 connected to the endless belt 1. The steps 2 are moved along the endless belt 1 and formed in segments. The curved escalator includes an intermediate portion 1a that is circular in plan view and inclined at a predetermined angle with respect to the horizontal. The intermediate portion 1a constitutes most of the load-bearing run of the endless belt-shaped steps. Both the upper and lower ends of the intermediate portion 1*a* are connected through upper and lower transition portions 1*b* and 1*b*, respectively, to substantially upper and lower landing portions 1*c* and 1*c*, respectively. The transition portions 1*b* and 1*b* smoothly connect the inclined intermediate portion 1*a* to the horizontal landing portions 1*c* and 1*c* so that the transition portions 1*b* and 1*b* have inclinations or gradients that gradually change for smooth connection. The extreme end of each of the horizontal landing portions 1*c* and 1*c* is provided with a turn-around portion 1*d* and 1*d* around which the endless belt 1 changes its travel direction and changes from the load-bearing run to the return run or vice versa.

The curved escalator also comprises on each side of the escalator a balustrade 3 including a handrail 5 thereon.

Figure 3:
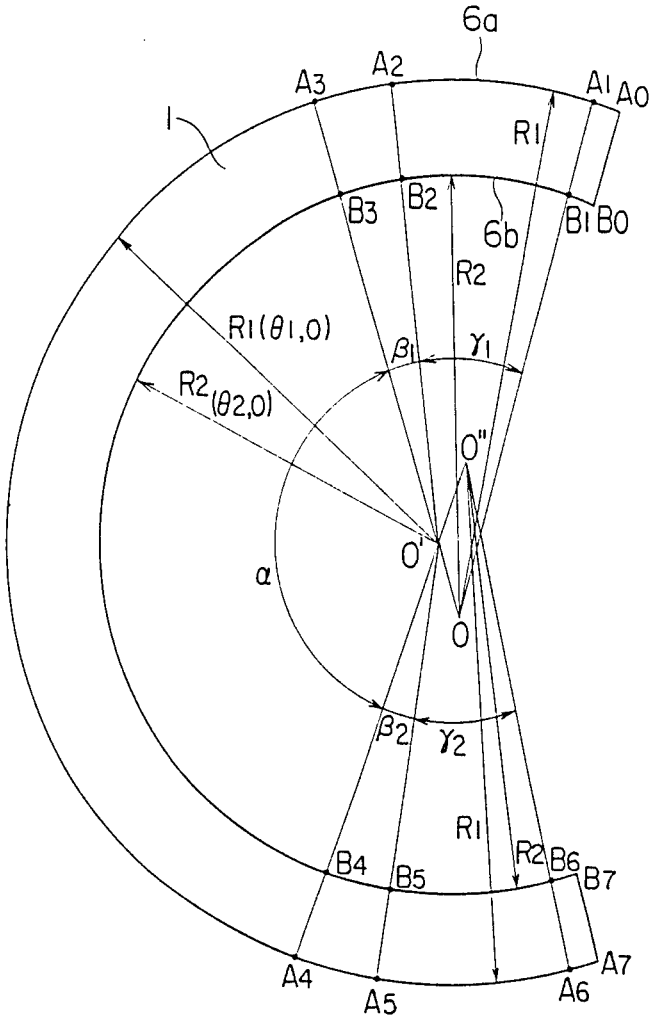
FIG. 3 is a diagram for explaining one embodiment of the moving handrail of the present invention.

In FIG. 3, in which the plan configuration of the escalator of the present invention is diagrammatically illustrated, on opposite sides of the stairway path 1, outer and inner handrail guide rails 6*a* and 6*b*, respectively, are disposed on the balustrades for supporting and guiding the moving handrails. Within the upper and lower horizontal moving sections A1-A2, A5-A6 and B1-B2, B5-B6 of the outer and inner handrail guide rails, the handrail guide rails are formed to have constant radii of curvature $R_1$ and $R_2$ having their centers O and O″ as viewed in plan. $\gamma_1$ and $\gamma_2$ are angles containing the upper and lower horizontal landing sections. Arcs $A_2$-$A_3$, $A_4$-$A_5$, $B_2$-$B_3$, and $B_4$-$B_5$ represent the upper and lower transition sections for the outer handrail guide rail, arcs $B_2$-$B_3$ and $B_4$-$B_5$ represent the upper and lower transition sections for the inner handrail guide rail in which the handrails gradually change their centers of curvature of the upper and lower curved sections O-O′ and O″-O′, and the radii of curvature $R_1(\theta_1)$ and $R_2(\theta_2)$ also gradually change. The angles $\theta_1$ and $\theta_2$ are slope angles of the outer and inner handrail guide rails, respectively, at any position, and $\beta_1$ and $\beta_2$ are central angles containing the upper and lower transition sections. $A_3$-$A_4$ and $B_3$-$B_4$ are constant slope angle sections of the outer and inner handrail guide rails, respectively, in which sections and handrail guide rails have a constant radius of curvature $R_1(\theta_1,O')$ and $R_2(\theta_2,O')$ having their respective centers at O′. Furthermore, the angle $\alpha$ is an angle at the center of containing the constant slope section. Arcs $A_0$-$A_1$ and $A_6$-$A_7$, as well as $B_0$-$B_1$ and $B_6$-$B_7$ are the upper and lower turn-around portions of the outer and inner handrail guide rails, respectively, and the handrail guide rails are straight in a horizontal projection, i.e., they have an infinite radius of curvature.

The handrail guide rails are constructed so that the following equations according to which the radius of curvature of the handrail guide rails is inversely proportional in a section of a large slope angle are satisfied:

$$R_1(\theta_1) \approx \frac{R_1(R_1 - R_2)\cos\theta_1}{R_1\cos\theta_1 - R_2\cos\theta_2}, \quad (1)$$

$$R_2(\theta_2) \approx \frac{R_2(R_1 - R_2)\cos\theta_2}{R_1\cos\theta_1 - R_2\cos\theta_2}, \quad (2)$$

where $R_1(\theta_1)$: radius of curvature of the outer handrail guide rail where the slope angle is $\theta_1$, $R_2(\theta_2)$: radius of curvature of the inner handrail guide rail where the slope angle is $\theta_2$, $R_1$: radius of curvature of the outer handrail guide rail in the horizontal section (value in plan), $R_2$: radius of curvature of the inner handrail guide rail in the horizontal section (value in plan), $\theta_1$: slope angle of the outer handrail guide rail at any position, $\theta_2$: slope angle of the inner handrail guide rail at any position.

Figure 4:
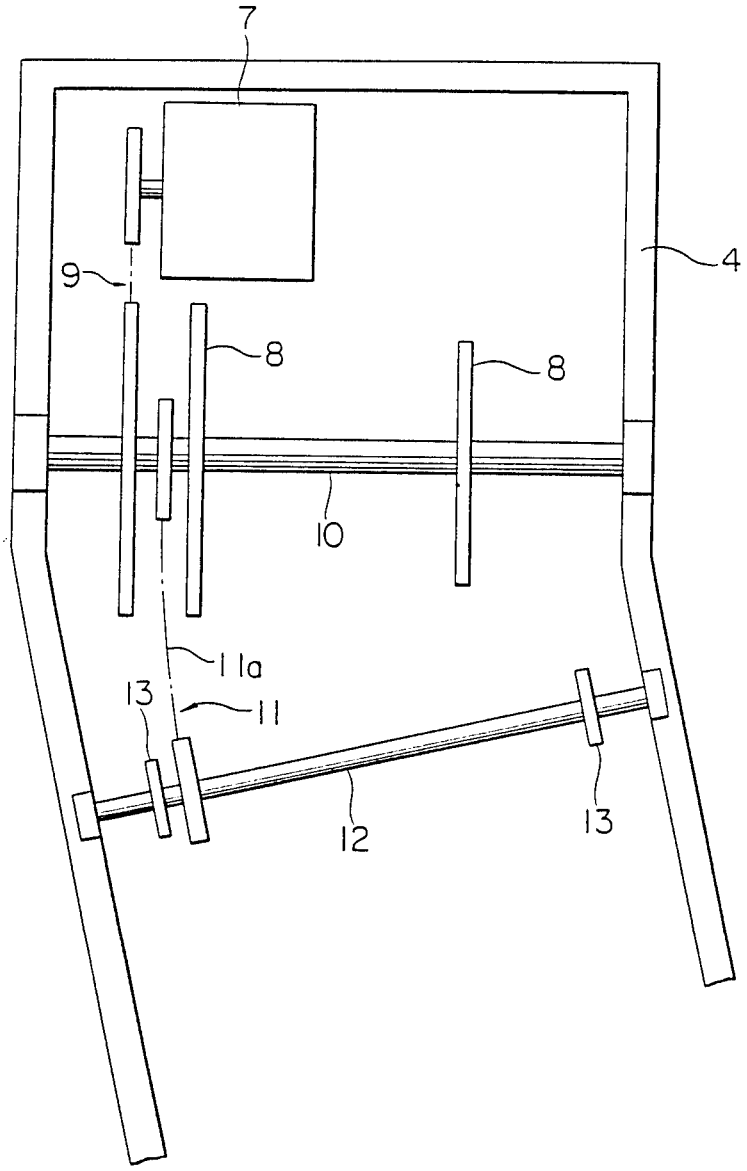
FIG. 4 is a plan view of a drive mechanism on one embodiment of the present invention.
Figure 5:
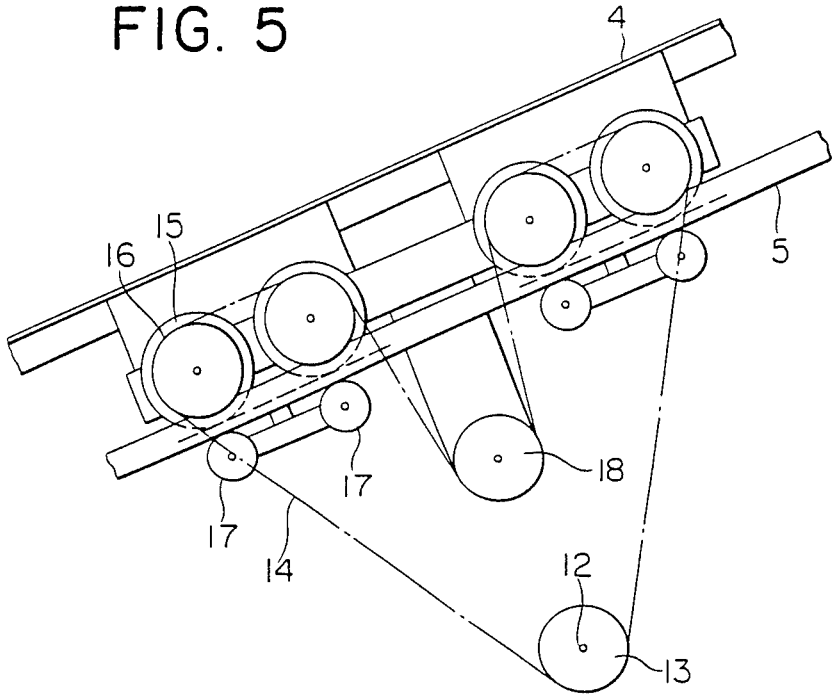
FIG. 5 is a plan view of a handrail drive mechanism of the present invention.

According to the handrail device of the illustrated embodiment, the moving handrails are driven in synchronization with the steps of a drive mechanism shown in FIGS. 4 and 5. In FIGS. 4 and 5, inner and outer sprocket wheels 8 around which the turn-around portions of the inner and outer step chains are wound are driven by a drive motor 7 through a transmission chain 9. A shaft 10 for the sprocket wheels 8 drives a handrail drive shaft 12 through the wound transmission chain 11 having a curved chain 11*a*. The sprocket wheel shaft 10 is rotatably supported from the main frame 4. A pair of handrail drive sprocket wheels 13 are securely mounted on the shaft 12. As seen from FIG. 5, an endless chain 14 drives a sprocket wheel 16 which is on the same shaft as handrail drive rollers 15, and pressure rollers 17, opposing the handrail drive rollers 15, together with the handrail drive rollers 15 hold the moving handrail 5 on its return run section. It is to be noted that the rollers 15 are supported on the main frame 4 and the pressure rollers 17 are resiliently supported on the main frame 4, and the endless chain 14 is supported and held in a desired tension.

The driving of the sprocket wheels 8 causes the synchronous driving of the outer and inner step chains, and the inner and outer sides of the steps are driven in synchronization. The outer and inner moving handrails 5 are also synchronously driven due to the turn-around portions wound around an unillustrated rotating member of a different radius. In order to move the steps horizontally, the step axles include a stepped portion.

Also, since the centers of curvature and the radii of curvature of the guide rails for guiding the steps and the handrail vary according to the change in the slope angle of the guide rails, the angular speed of the steps and the moving handrails are synchronous and the widthwise separation between the steps and the moving handrails do not theoretically occur.

It will now be explained how the positional relationship between the steps and the moving handrails is substantially constant.

Wherein, $R_1'(\theta_1')$: radius of curvature of the outer step guide rail where the slope angle is $\theta_1'$, $R_2'(\theta_2')$: radius of curvature of the inner step guide rail where the slope angle is $\theta_2'$, $R_1'$: radius of curvature of the outer step guide rail in the horizontal section (value in plan), $R_2'$: radius of curvature of the inner step guide rail in the horizontal section (value in plan), $\theta_1$: slope angle of the outer handrail guide rail at any position, $\theta_2$: slope angle of the inner handrail guide rail at any position, then the following equations hold and the widthwise distance between the steps and the moving handrail in any position can be substantially constant:

$$R_1'(\theta_1') \approx \frac{R_1'(R_1' - R_2')\cos\theta_1'}{R_1'\cos\theta_1' - R_2'\cos\theta_2'}, \quad (3)$$

$$R_2'(\theta_2') \approx \frac{R_2'(R_1' - R_2')\cos\theta_2'}{R_1'\cos\theta_1' - R_2'\cos\theta_2'}, \quad (4)$$

$$R_1(\theta_1)\tan\theta_1 = R_2(\theta_2)\tan\theta_2 = R_1'(\theta_1')\tan\theta_1' = R_2'(\theta_2')\tan\theta_2' \quad (5)$$

$$R_2'(\theta_2') - R_2(\theta_1) \approx \frac{R_2'(R_1' - R_2')\cos\theta_2'}{R_1'\cos\theta_1' - R_2'\cos\theta_2'}, - \frac{R_2'(R_1' - R_2')\cos\theta_2'}{R_1'\cos\theta_1' - R_2'\cos\theta_2'} \approx R_2' - R_2 \text{ (Const.)} \quad (6)$$

$$R_1(\theta_1) - R_1'(\theta_1') \approx \frac{R_1(R_1 - R_2)\cos\theta_1}{R_1\cos\theta_1 - R_2\cos\theta_2}, - \frac{R_1'(R_1' - R_2')\cos\theta_1'}{R_1'\cos\theta_1' - R_2'\cos\theta_2'} \approx R_1 - R_1' \text{ (Const.)} \quad (7)$$

As described above, according to the present invention, the radii of curvature and center of curvature are changed in accordance with the change in the slope angle while holding the step guide rails and the handrail guide rails in a corresponding relationship, and the angular velocities of the inner moving handrail and the outer moving handrail are equal so that the handrails and the steps are in synchronization with each other. Further, the widthwise distances between the steps and the moving handrails do not change, thereby improving the safety of the escalator.

Figure 6:
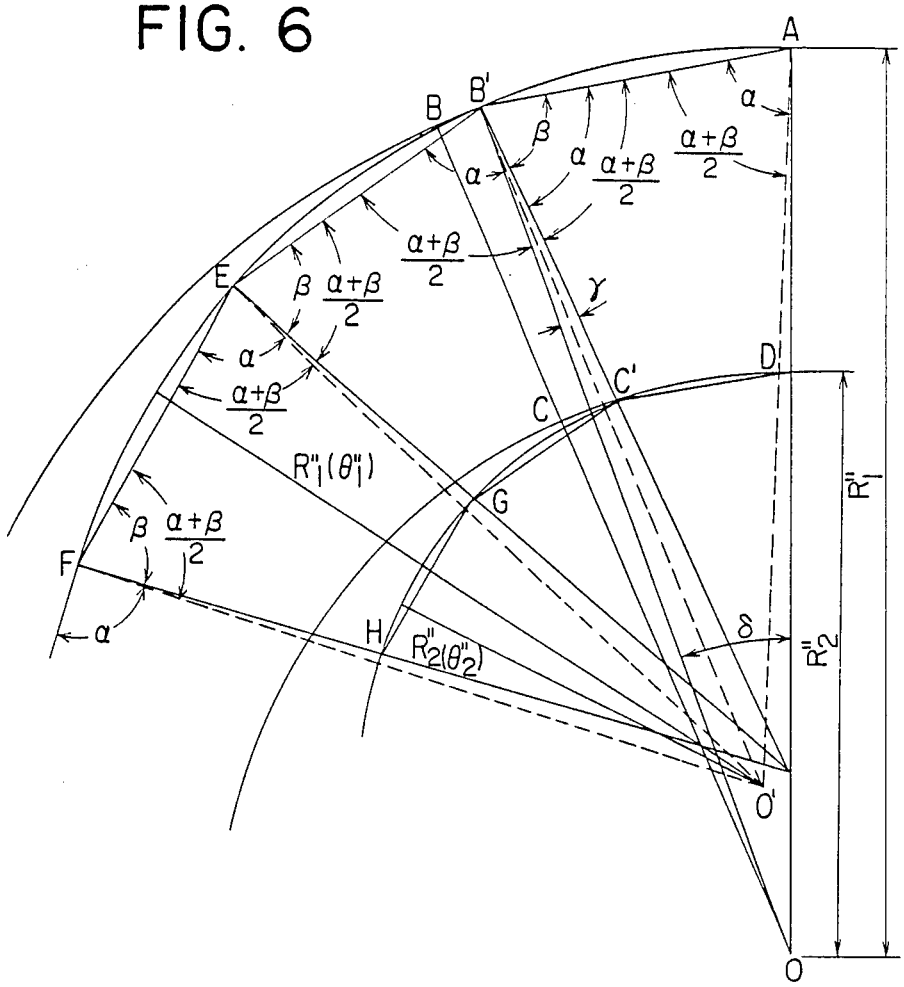
FIG. 6 is a diagram for explaining one embodiment of the relationship between the slope angle of the steps and the radius of curvature of the guide rail.

FIG. 6 illustrates the principles of the step formation of the present invention in which the geometry of the steps is illustrated when the step axles of the adjacent steps are directly connected by a roller chain or a link chain.

In the upper and lower horizontal sections, the step top surface can be designated by a segment of a trapezoid ABCD since there is no overlapping portion resulting from the difference in elevation between the adjacent steps. The exposed surface of the steps in the constant inclination section is AB'C'D when the angles of inclination at the portion corresponding to the outer and inner peripheries of the step are $\theta_1''$ and $\theta_2''$, respectively. Thus, the overlapping portion between the adjacent steps is BB'C'C. Then, the exposed surface of the connected steps is a polygon AB'EF . . . DC'GH . . . which is composed of a plurality of trapezoids AB'C'D placed on a plane in a side-by-side relationship. When the radius of a circumscribed circle connecting the outer points AB'EF . . . of the polygon is $R_1''(\theta_1'')$ and the radius of a circumscribed circle connecting the inner points DC'GH . . . of the same polygon is $R_2''(\theta_2'')$, then the following equation holds true. When $\theta_1''=\theta_2''=0$, the radii of the circumscribed circles on the outer and inner peripheries of the above polygon are $R_1''$ and $R_2''$, respectively, and arc $AB=l_1$ and arc $CD-l_2$.

$$R_1'\delta = \text{Arc } AB \cos\theta_1'' = l_1\cos\theta_1''$$

$$\delta = \frac{l_1}{R_1''}\cos\theta_1'' \quad (8)$$

If angle $DAB' = \alpha$, angle $AB'C' = \beta$, angle $OB'C' = \gamma$ and angle $BO'A$ = angle $\delta$, $$\beta = \alpha - \gamma \approx \alpha - \frac{R_2''\delta - l_2\cos\theta_2''}{R_1'' - R_2''}$$

$$\alpha = \frac{\pi - \delta}{2}$$

$$\alpha + \beta = \frac{R_1'' - l_1\cos\theta_1''}{R_1''} - \frac{R_2''l_1\cos\theta_1'' - R_1''l_2\cos\theta_2''}{R_1''(R_1'' - R_2'')} \quad (9)$$

$$R'\cos\frac{\alpha+\beta}{2} = R_1'\sin\frac{\delta}{2} \quad (10)$$

$$R'(\theta_1') = \frac{R_1'\sin\left(\frac{l_1}{2R_1''}\cos\theta_1'\right)}{\cos\left(\frac{\pi_1' - l_1\cos\theta_1'}{2R_1'} - \frac{R_2'l_1\cos\theta_1' - R_1'l_2\cos\theta_2'}{2R_1'(R_1' - R_2')}\right)}$$

$$R_1''(\theta_1'') \approx \frac{R_1''(R_1'' - R_2'')\cos\theta_1''}{R_1''\cos\theta_1'' - R_2''\cos\theta_2''} \quad (11)$$

Although the steps between Equations (10) and (11) are omitted, Equation (11) expresses an approximate value with an accuracy of about 0.01%.

Similarly, $$R_2''(\theta_2'') \approx \frac{R_2'' - (R_1'' - R_2'')\cos\theta_2''}{R_1''\cos\theta_1'' - R_2''\cos\theta_2''}$$

Therefore, the radius of the outer step guide rail should be $$R_1'(\theta_1') \approx \frac{R_1'(R_1' - R_2')\cos\theta_1'}{R_1'\cos\theta_1' - R_2'\cos\theta_2'} \quad (12)$$

and the radius of the inner guide track should be $$R_2'(\theta_2') \approx \frac{R_2'(R_1' - R_2')\cos\theta_2'}{R_1'\cos\theta_1' - R_2'\cos\theta_2'}, \quad (13)$$

Thus, when the gradients or the inclinations of the outer and the inner guide rails are $\theta_1'$ and $\theta_2'$, respectively, and the steps are to be supported and guided in the intermediate constant inclination section, the circular guide rails should have radii of curvature $R_1'(\theta_1')$ and $R_2'(\theta_2')$ and a center of O'. When the steps are to be guided in the upper and lower horizontal sections, the guide rails for guiding the steps should have a center O with radii of curvature $R_1'$ and $R_2'$. Since the inclination is constant in the intermediate constant inclination section, the radii of curvature of the guide rails are also constant, and the radii of curvature of the guide rails in the upper and lower transition sections vary according to Equations (12) and (13) with varying $\theta_1'$ and $\theta_2'$.

FIGS. 7 to 13 illustrate one embodiment of the skirt guard of the curved escalator of the present invention. The escalator comprises an outer drive chain 20 and an inner drive chain 21 which constitute the endless belt 1 shown in FIG. 1. The outer and inner chains 20 and 21 are connected to a step axle 19 mounted on each of the steps 2, and each end of the step axle 19 has mounted thereon a rotatable drive roller 22. The drive rollers 22 are supported and guided on outer and inner guide rails 24 and 26 fixedly mounted on the truss of frame 4 of the escalator. The step 2 also has another axle on which follower rollers 23 are rotatably mounted. The follower rollers 23 are also supported and guided by guide rails 25 and 27 secured on the frame 4.

Figure 7:
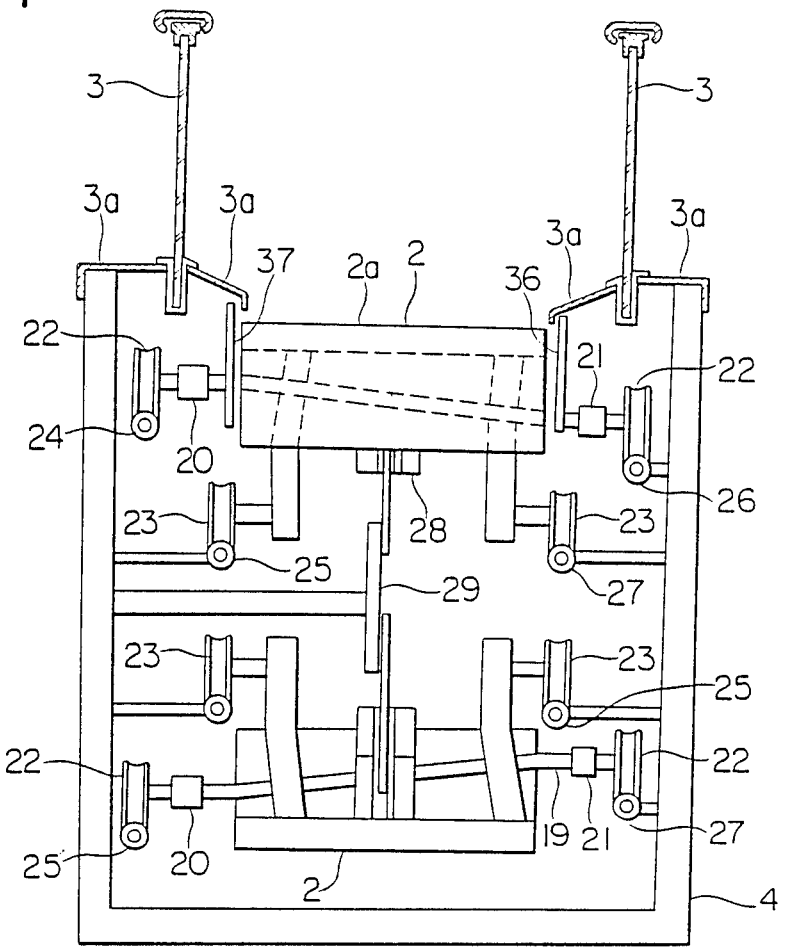
FIG. 7 is a front view showing the steps and the guide system therefor of one embodiment of the curved escalator of the present invention.
Figure 8:
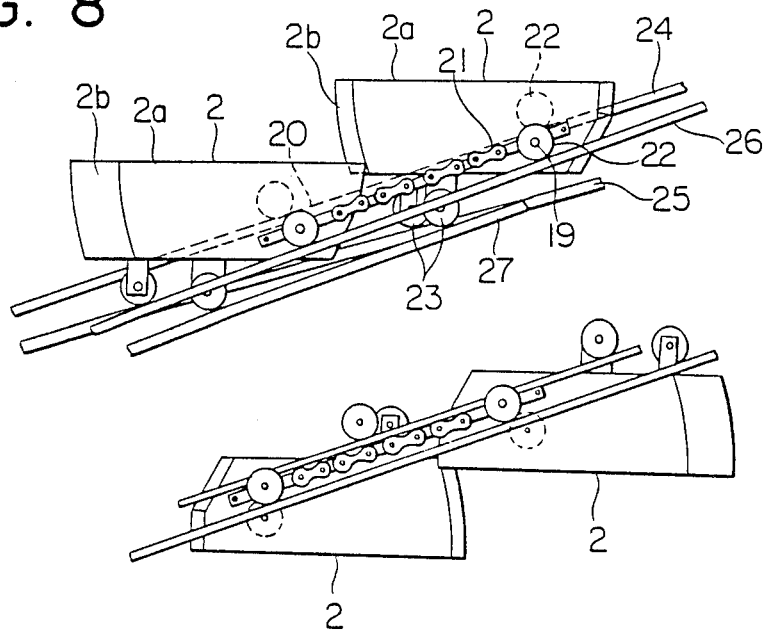
FIG. 8 is a side view of the constant slope intermediate section of the embodiment of a curved escalator shown in FIG. 7.
Figure 9:
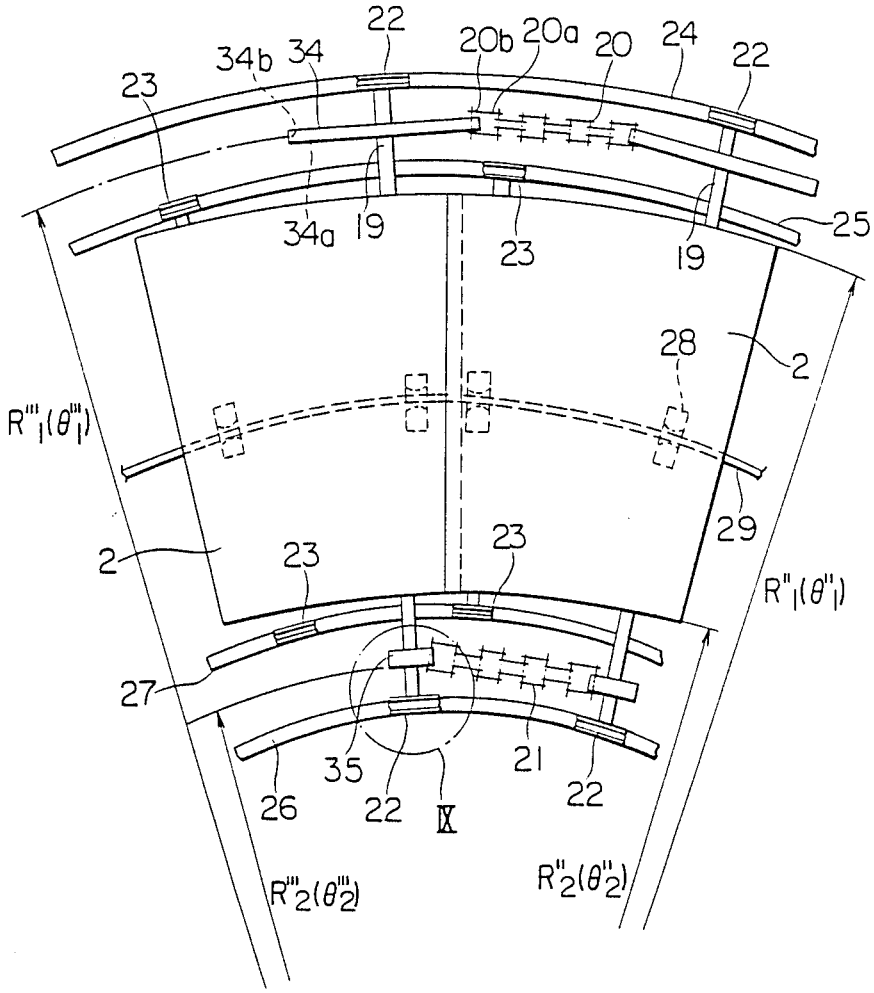
FIG. 9 is a plan view of the constant slope intermediate section of the embodiment of a curved escalator shown in FIG. 7.

As shown in FIGS. 7 to 9, the step axle 19 supporting the segment step 2 through an attachment that is not illustrated is constructed to have staggered end portions so that the outer drive roller 22 is positioned higher than the inner drive roller 22 in the load-bearing run. Therefore, the guide rails 24 and 26 for supporting and guiding the respective drive rollers 22 are also positioned at different levels. The outer and inner chains 20 and 21 driven by a drive mechanism, which will be described in detail later, causes the steps 2 to be driven along the guide rails 24 and 26. The follower rollers 23 on the guide rails 25 and 27 are disposed below and interior to the drive rollers 22 and function, in cooperation with the guiding function of the drive rollers 22 and the guide rails 24 and 26, to maintain a desired horizontal position of the steps 2 while they are travelling in the load-bearing run and the return run of the endless belt. The outer guide rails 24 and 25 and the inner guide rails 26 and 27 are arranged according to the previously described relationship between the radius of curvature and the inclination of the escalator, i.e., the radii of curvature of the guide rails are inversely proportional to their inclinations, whereby the step axles 19 can be directly connected to the outer and inner drive chains 20 and 21. The steps 2 also have on their reverse side a guide shoe 28 or a wheel in engagement with a guide rail 29 centrally disposed and rigidly mounted on the frame 4 of the escalator. The guide shoe 28 moves along the rail 29 to limit lateral movement of the steps 2.

As shown in FIG. 8, each step 2 has formed thereon a tread part 2*a* and a riser 2*b* which include a plurality of cleats (not shown) extending perpendicular to the surface of the tread part 2*a* and meshing with the cleats (not shown) on the tread part 2*a*.

Figure 10:
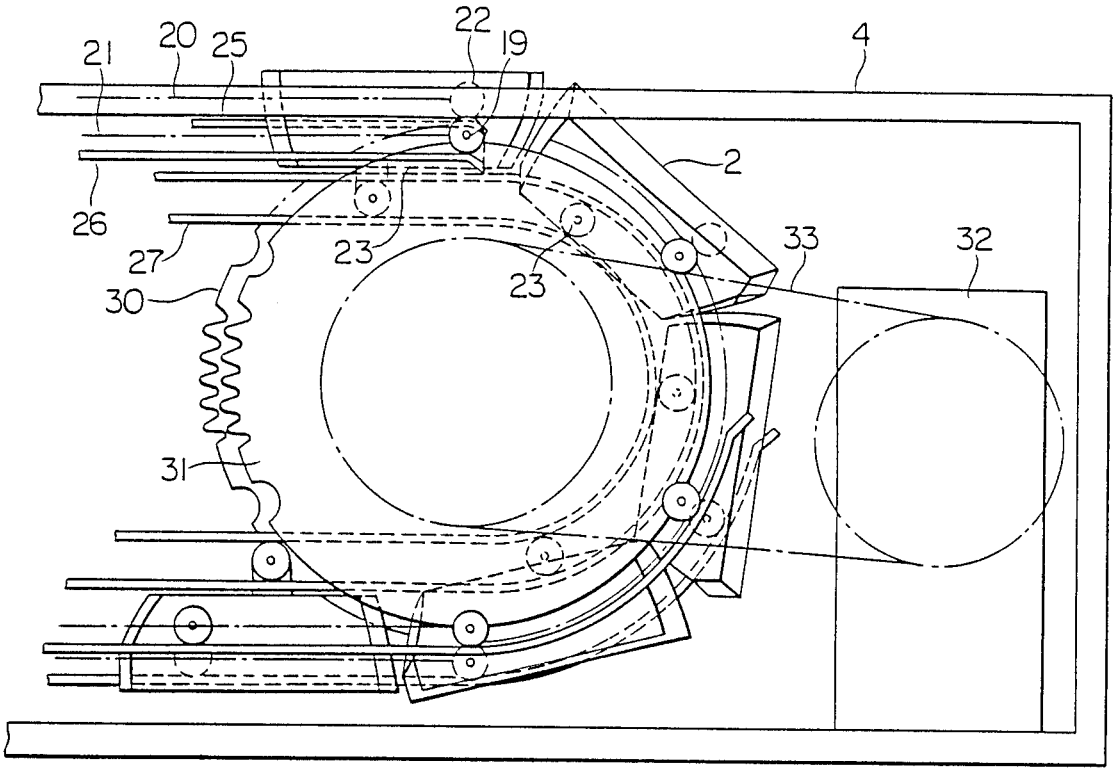
FIG. 10 is a side view of a turn-around portion of the embodiment of a curved escalator shown in FIG. 7.

The drive mechanism for driving the endless belt of the escalator comprises an electric motor 32 for driving, through a drive chain 33, sprocket wheels 30 and 31 as shown in FIG. 10 in which the turn-around portion of the endless belt is illustrated together with the driving mechanism. As illustrated, the outer and inner drive chains 20 and 21 are wound around the larger and the smaller sprocket wheels 30 and 31, respectively. The pitch circle of the larger sprocket wheel 30 which engages the outer chain 20 is larger than that of the smaller sprocket wheel 31 engaging the inner chain 21 by an amount that is determined by the ratio of the radii of curvature $R_1'''$ and $R_2'''$ of the chains in the horizontal landing portions of the endless belt so that the outer and the inner chains 20 and 21 are assured to be driven at the same constant angular velocity.

It is to be noted that the lower turn-around portion of the curved escalator has a set of larger and smaller follower sprocket wheels that are similarly dimensioned to those just described to guide the outer and inner driving chains, respectively. The lower set of follower sprocket wheels are mounted on a movable platform that is movable along articulated rails in accordance with the elongation of the chains so that a predetermined necessary tension is provided in the chains. Such a chain tensioner arrangement may be a conventional one known in the art.

In the upper and lower turn-around portions of the endless belt, the step axles 19 turn about the sprocket shaft (not shown) in a truncated conical surface.

The vertical distance h between the positions of the ends of the step axles 19 is expressed by the following equation when the radii of the outer and inner sprocket wheels 30 and 31, respectively, are $r_1$ and $r_2$ and the radii of curvature of the outer and inner chains in the horizontal section are $R_1'''$ and $R_2'''$, respectively:

$$h = r_1 - r_2\frac{r_1}{r_2} = \frac{R_1'''}{R_2'''}.$$

Figure 11:
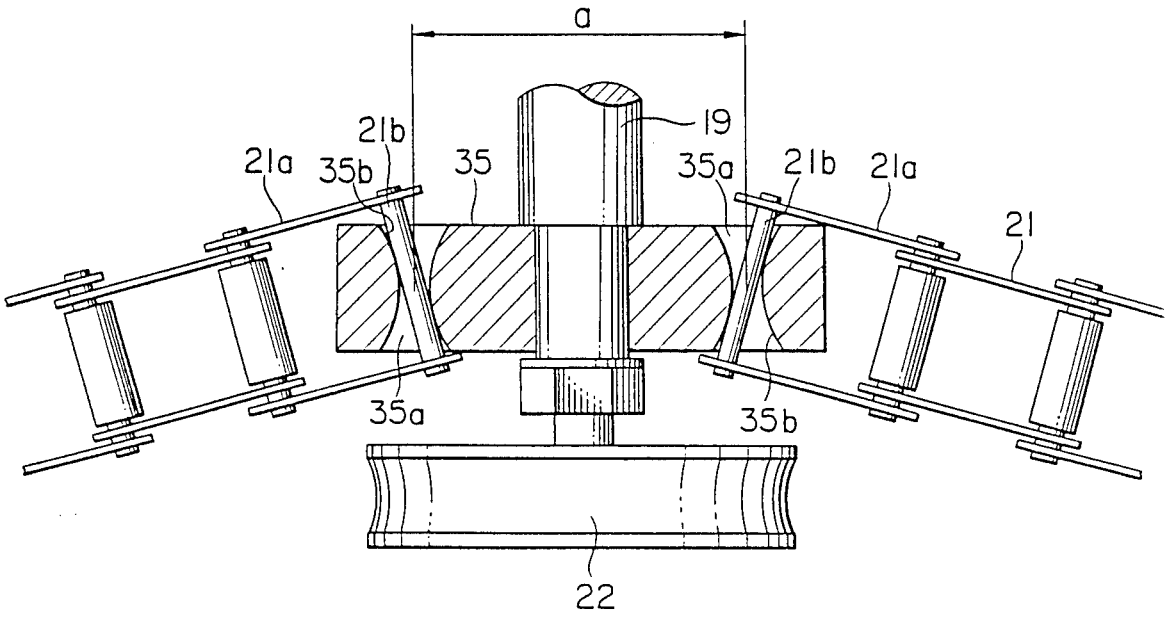
FIG. 11 is an enlarged sectional view of the portion encircled by a circle IX in FIG. 9.
Figure 12:
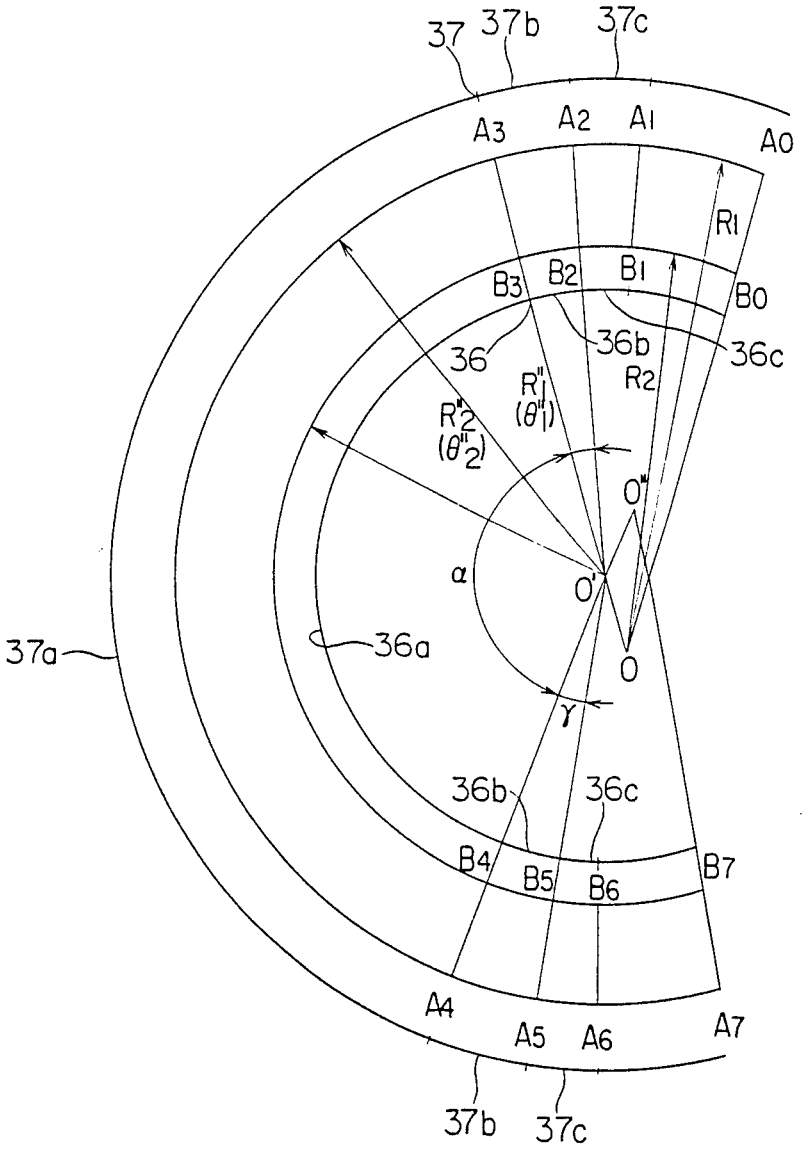
FIG. 12 is a view similar to FIG. 3 illustrating the arrangement of the skirt guard shown in FIG. 7.

As shown in FIGS. 7 and 9, the endless belt includes an outer connecting plate 34 and an inner connecting plate 35 mounted on the outer and the inner end portions of the step axle 19, respectively. The connection plates 34 and 35 are of similar construction except that their lengths measured in the direction of the chain extension are different. As best seen in FIG. 11, the connecting plate 35 has through holes 35*a* at opposite ends thereof through which a pin 21*b* between chain links 21*a* at the end of the chain 21 extend. It is to be noted that each of the through holes 35*a* in the ends of the connecting plate 35 is defined by an inwardly convex curve which is rotated about the axis of the hole 35*a*. Also, the distance a between the centers of the through holes 35*a* in the connecting plate 34 is selected so that it is not equal to a pitch p of the outer or inner chain multiplied by an integer. The reason that this distance should not be equal to an integer multiple of the chain pitch p is that, in the actual design of the escalator, the ratio $1_1'/1_2'$ of the distances between the adjacent step axles of the outer and the inner driving chains must be selected to equal the ratio $r_1/r_2$ of the radii of the sprocket wheels in the horizontal section of the endless belt, and if the distance a is selected to be np (p multiplied by an integer), the distance in the widthwise direction between the outer and the inner driving chains 20 and 21 must be considerably large in order to obtain a practical design. On the other hand, if the distance a between the centers of the through holes 35*a* is not equal to the chain pitch p, the widthwise dimension w between the outer and inner driving chains 20 and 21 can be any desired value. Also, the pitches p of the outer and inner driving chains 20 and 21 need not be always equal to each other and may correspond to the ratio $1_1'/1_2'$ of the distances between the adjacent step axles of the outer and the inner driving chains 20 and 21.

Although not illustrated, the moving handrail is driven by a drive force from the sprocket wheels disposed in the turn-around portion of the escalator. This arrangement enables a continuous handrail to be driven without an angular velocity differential and without the need for a variable speed moving handrail.

Figure 13:
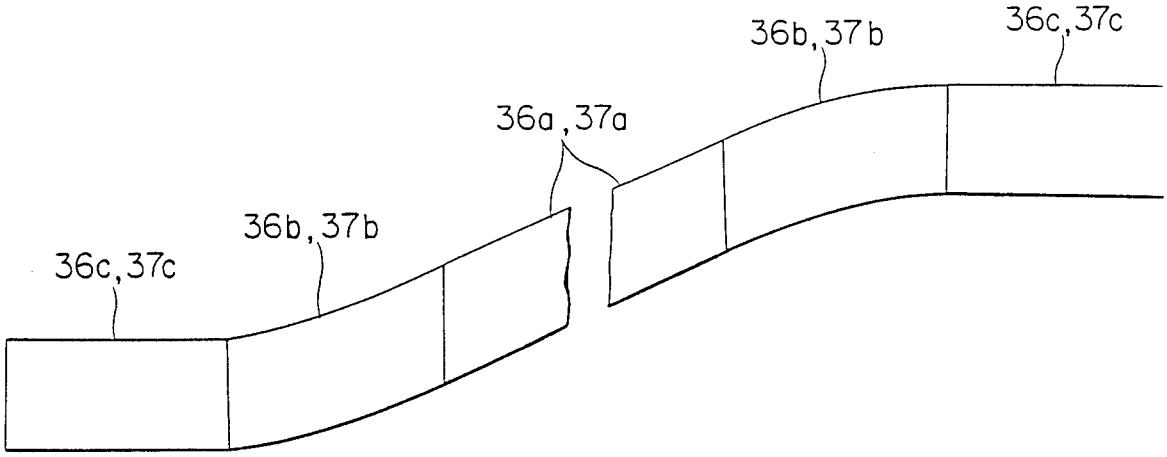
FIG. 13 is a segmented side view showing the skirt guard of FIG. 7.

In FIG. 7, each of the balustrades 3 has a base deck 3*a* which is provided at its inner side edge close to the steps 2 with an inner skirt guard 36 and an outer skirt guard 37. The skirt guards 36 and 37 are firmly attached to the side edges of the deck 3*a*. As shown in FIG. 13, the skirt guards 36 and 27 comprise intermediate skirt guards 36*a* and 37*a* disposed in parallel to the intermediate constant slope sections of the outer and the inner guide rails 24, 25, 26, and 27. Upper and lower transition skirt guards 36*b* and 37*b* are parallel to the upper and the lower transition guide rails. Upper and lower end skirt guards 36*c* and 37*c* are parallel to the corresponding portions of the guide rails. Thus, the inner skirt guard 36 and the outer skirt guard 37 are disposed in parallel to the travel path of the steps 2 that are guided and moved along the outer guide rails 24 and 25 and the inner guide rails 26 and 27. Therefore, the clearance or the widthwise distance between the side edges of the steps 2 and the outer and the inner skirt guards 36 and 37 is always maintained substantially constant, thereby ensuring the safety of passengers on the escalator.

As has been described, since the step axles are supported and guided at their drive rollers mounted thereon by the outer and the inner guide rails, the step axles can be directly connected to the drive chains to move the steps so that the structure is simple and the regulation of the distance between the adjacent steps is facilitated. Also, the widthwise distance between the steps and the skirt guards is maintained constant, ensuring a higher degree of safety. Furthermore, the step axles are positioned in symmetry with respect to the horizontal while they are in the load-bearing run and in the return run of the stairway path so that manufacture is easy and manufacturing cost is low.

Figure 14:
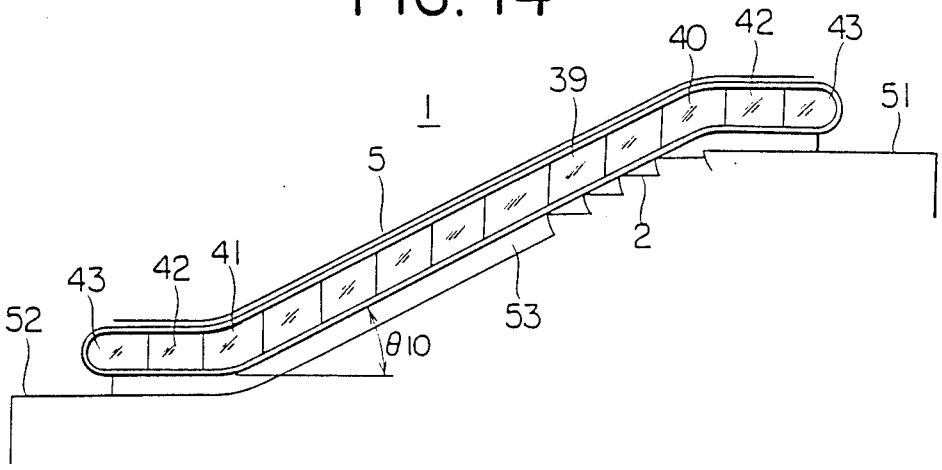
FIG. 14 is a side view of the inner balustrade panel on the outer side of the stairway path of an embodiment of the present invention.

FIG. 14 is a side view of the inner panel of the outer balustrade in which the inner panel 38 on the outer side of the balustrade extending along the length direction of the stairway path 1 comprises intermediate constant slope inclined sections 39, upper and lower transient sections 40 and 41 having changing slope angles, upper and lower horizontal landing sections 42, and upper and lower newel sections 43 connected to the upper and the lower landing sections 42. The constant slope intermediate sections are further divided.

Figure 15:
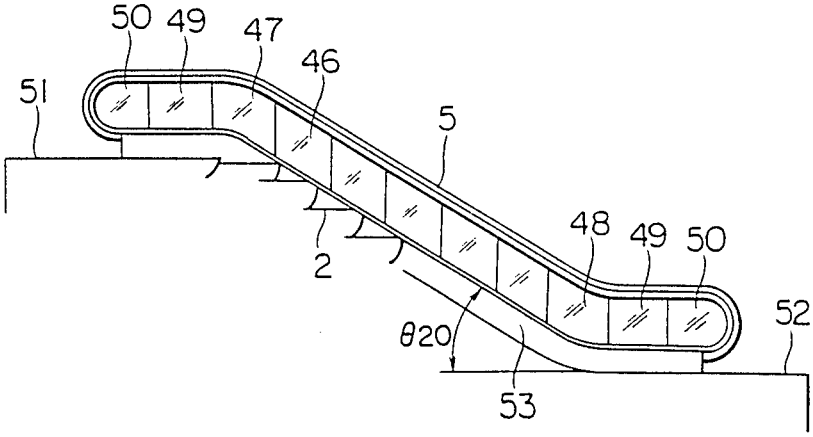
FIG. 15 is a side view of the inner balustrade panel on the inner side of the stairway path on the embodiment shown in FIG. 14.

FIG. 15 is a side view of the inner panel of the inner peripheral balustrade. The inner panel comprises intermediate constant slope sections 46, an upper transition section 47, a lower transition section 48, upper and lower horizontal landing sections 49, and upper and lower newel sections 50 connected to the upper and the lower landing sections 49. The intermediate constant slope sections 46 have further subsections. In FIGS. 14 and 15, the reference numerals 51 and 52 designate upper and lower floor panels, and the reference numeral 53 designates a skirt guard.

Figure 16:
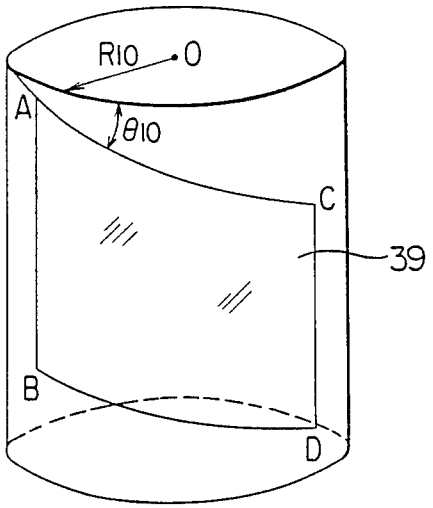
FIG. 16 is a view showing the shape of the section of the inner balustrade panel on the outer side of the stairway path of the embodiment of the present invention.

As shown in FIG. 16, each of the intermediate constant slope sections 39 of the inner panel on the inner balustrade is formed by pressing a trapezoid ABCD on a cylinder of radius $R_{10}$ with the sides AB and CD vertical and the other sides at angles $\theta_{10}$, and the intermediate constant slope section 46 of the inner panel on the outer balustrade is formed by pressing a trapezoid on a cylinder of radius $R_{20}$ with an inclination $\theta_{20}$.

Figure 17:
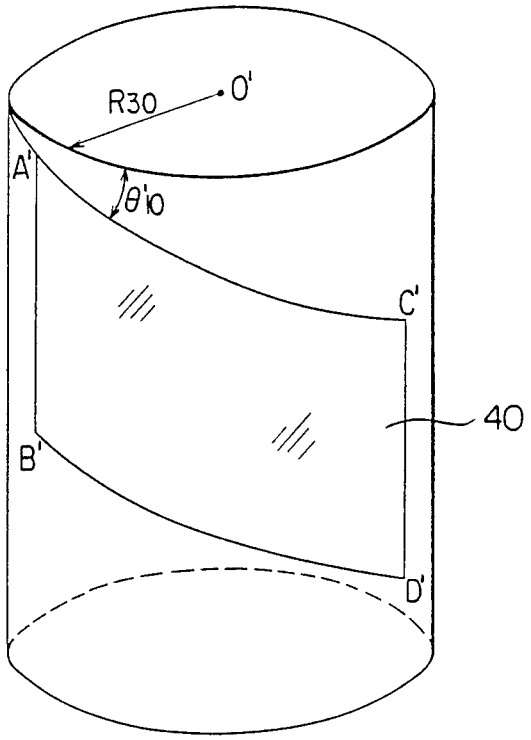
FIG. 17 is a view showing the shape of the section of the inner balustrade panel on the outer side of the stairway path in the upper transition section of the embodiment of the present invention.

As shown in FIG. 17, the upper transition section 40 of the outer side is formed by pressing a trapezoid A'B'C'D' on a cylinder of radius $R_{30}$ with the sides A'B' and C'D' vertical and with a varying inclination of $\theta_{10}$ to zero. Similarly, the upper transition section 47 of the inner side is formed by pressing a trapezoid on a cylinder of a radius $R_{40}$ with the inclination changing from $\theta_{20}$ to zero. The lower transition sections of the outer and the inner sides can also be similarly constructed. The upper and the lower horizontal landing sections 42 and 49 on the outer and the inner sides are formed by pressing a rectangle on a cylinder of radii of $R_{10}'$ and $R_{20}'$ at an inclination angle of zero, and the newel section at the opposite ends 43 and 50 are planar panels.

The inner panels of the balustrades of the embodiment as described above may be manufactured by pressing sheets of glass or plastic material with eight kinds of pressing dies, i.e., two for the intermediate constant slope sections 39 and 46 for the outer and the inner balustrades, four for the upper and the lower transition sections 40, 47, 41, and 48 for the outer and the inner balustrades, and two for the upper and the lower horizontal landing sections 42 and 49 for the outer and the inner balustrades. Therefore, the manufacture of the inner panels can be relatively inexpensive in that only relatively few kinds of pressing dies are needed.

As has been described, the present invention provides a curved escalator in which the inner balustrade panel of the balustrade is divided into sections of simple configuration so that the manufacture of the panels can be made with a small number of press-forming dies at a lower cost.

What is claimed is:

1. A curved escalator mounted on a frame comprising:

a stairway path curved in plan and having an intermediate section that has a predetermined constant slope angle, upper and lower landing sections that have substantially zero slope angle, and transition sections that connect said intermediate section to said upper and lower sections and have gradually changing slope angles for the smooth connection thereof;

a plurality of segment steps movable along said stairway path;

an inner balustrade panel of a balustrade vertically disposed along an outer side and an inner side of said stairway path;

outer and inner moving handrails, outer and inner skirt guards;

means mounting said skirt guards to said frame and extending in parallel to the path of said steps so as to maintain substantially constant clearance between said skirt guards and said steps;

means for guiding said steps along said stairway path; and outer and inner handrail guide rails for guiding said handrails, the radius of curvature of said outer and said inner handrail guide rails determined by the following equations, respectively:

$$R_1(\theta_1)=(R_1(R_1-R_2)\cos\theta_1)/(R_1\cos\theta_1-R_2\cos\theta_2)$$

$$R_2(\theta_2)=(R_2(R_1-R_2)\cos\theta_2)/(R_1\cos\theta_1-R_2\cos\theta_2)$$

where $R_1(\theta_1)$: radius of curvature of the outer handrail guide rail where the slope angle is $\theta_1$;

$R_2(\theta_2)$: radius of curvature of the inner handrail guide rail where the slope angle is $\theta_2$;

$R_1$: radius of curvature of the outer handrail guide rail in the zero slope section;

$R_2$: radius of curvature of the inner handrail guide rail in the zero slope section;

$\theta_1$: slope angle of the outer handrail guide rail at any position;

$\theta_2$: slope angle at the inner handrail guide rail at any position.

2. A curved escalator as claimed in claim 1 wherein said each of said inner balustrade panels is made of glass or a plastic material.

3. A curved escalator as claimed in claim 1 wherein said skirt guard comprises:

an intermediate skirt guard secured on said frame in parallel with the path of said steps within said constant slope intermediate section;

upper and lower skirt guards secured on said frame in parallel with the path of said steps within said upper and lower transition sections; and end skirt guards secured to said frame in parallel with the path of said steps within said upper and lower landing sections.

4. A curved escalator as claimed in claim 1 wherein an inner balustrade panel of said balustrade is divided into a constant slope section, upper and lower transition sections, and upper and lower landing sections, each of these sections having the form of a cylindrical surface of a different radius and having vertical end faces.

5. A curved escalator as claimed in claim 4 wherein said inner balustrade panels of said upper and lower landing sections comprise at newel portions planar panels.

* * * * *